US007717634B1

(12) United States Patent
Budelsky et al.

(10) Patent No.: US 7,717,634 B1
(45) Date of Patent: May 18, 2010

(54) TROUGH SUPPORT RIBS

(75) Inventors: Stephen Andrew Budelsky, Lexington, KY (US); David Wayne DeVore, Richmond, KY (US); Derick Matthew Foley, Lexington, KY (US); John Phillip Logan, Winchester, KY (US); Michael Anthony Marra, III, Lexington, KY (US); David Kyle Murray, Lexington, KY (US); Mark Arthur Rufi, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 821 days.

(21) Appl. No.: 11/329,760

(22) Filed: Jan. 11, 2006

(51) Int. Cl.
*B41J 2/185* (2006.01)
*B41J 2/01* (2006.01)
*B41J 2/17* (2006.01)
*B41J 2/18* (2006.01)

(52) U.S. Cl. ..... 400/656; 347/1; 347/36; 400/348

(58) Field of Classification Search ..... 347/1, 347/20, 22, 34, 35, 36, 101, 104, 105; 400/648, 400/656; *B41J 2/01, 2/14, 2/18, 2/185*
See application file for complete search history.

(56) References Cited

U.S. PATENT DOCUMENTS

| | | | | |
|---|---|---|---|---|
| 5,393,151 | A | 2/1995 | Martin et al. | |
| 5,684,516 | A | 11/1997 | Cseledy et al. | |
| 5,997,129 | A | 12/1999 | Matsuhashi | |
| 6,239,817 | B1 | 5/2001 | Meyer | |
| 6,357,851 | B1 | 3/2002 | Gaasch | |
| 6,517,269 | B1 | 2/2003 | Scholz et al. | |
| 6,575,554 | B2 | 6/2003 | Yoshinaga | |
| 6,604,811 | B2 | 8/2003 | Sawicki | |
| 6,616,266 | B2 | 9/2003 | Neal et al. | |
| 6,709,088 | B2 * | 3/2004 | Hayakawa et al. | 347/31 |
| 6,796,648 | B2 | 9/2004 | Ohashi | |
| 6,817,696 | B2 | 11/2004 | Miki et al. | |
| 6,820,962 | B2 | 11/2004 | Uchida | |
| 6,840,617 | B2 | 1/2005 | Crosby et al. | |
| 6,860,583 | B2 | 3/2005 | Cheney et al. | |
| 6,866,361 | B2 | 3/2005 | Kuki et al. | |
| 6,935,737 | B2 * | 8/2005 | Kanome et al. | 347/104 |
| 6,964,466 | B1 * | 11/2005 | Kodama et al. | 347/36 |
| 7,204,577 | B2 * | 4/2007 | Kanamitsu et al. | 347/31 |
| 7,360,888 | B2 * | 4/2008 | Otsuki | 347/104 |
| 2002/0135653 | A1 * | 9/2002 | Otsuki | 347/104 |
| 2004/0027412 | A1 * | 2/2004 | Takahashi et al. | 347/34 |

(Continued)

FOREIGN PATENT DOCUMENTS

JP 2002001995 A * 1/2002

(Continued)

*Primary Examiner*—Judy Nguyen
*Assistant Examiner*—'Wyn' Q Ha
(74) *Attorney, Agent, or Firm*—Middleton & Ruetlinger

(57) ABSTRACT

A trough support rib for improved edge-to-edge printing having a media feedpath extending in a first direction, a printhead reciprocally movable in a second direction, the second direction defining a print zone, an ink trough, at least one support rib beneath the print zone within the ink trough, the at least one support rib having an upper angled edge for engaging print media defined by two beveled surfaces, the rib further including a notch for removal of overspray ink to the ink trough.

53 Claims, 12 Drawing Sheets

U.S. PATENT DOCUMENTS

2004/0125164 A1* 7/2004 Park et al. ..... 347/16
2005/0179758 A1* 8/2005 Campillo et al. ..... 347/101
2005/0225626 A1* 10/2005 Igarashi et al. ..... 347/234

FOREIGN PATENT DOCUMENTS

JP 2002211056 A * 7/2002
JP 2003034024 A * 2/2003
JP 2003320688 A * 11/2003
JP 2003326798 A * 11/2003
JP 2003334976 A * 11/2003
JP 2004042442 A * 2/2004
JP 2004250121 A * 9/2004
JP 2005022286 A * 1/2005
JP 2005053235 A * 3/2005
JP 2005144807 A * 6/2005
JP 2006001140 A * 1/2006

* cited by examiner

TROUGH SUPPORT RIBS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention relates generally to media support structures, and more particularly to a media support structures which improve edge-to-edge printing.

2. Description of the Related Art

Digital photo printing has increased in popularity in recent years due to the increased popularity of digital cameras. Generally, digital cameras convert an optical image to a digital image through a charge-coupled device (CCD) image sensor or the like. The digital image may then be saved to an image memory for further data processing. In recent years digital camera features have improved significantly. For example, digital camera resolutions and memory storage capabilities have increased while prices for such features have steadily decreased, leading to increased digital camera sales. As a result of increased use of digital cameras, edge-to-edge photo printing has increased. Users desire developed pictures having the look, feel and size of photos developed by professional developers.

Manufacturers have developed various photo printers which print the digital images to media comparable to professionally developed photos. Current manufacturers have primarily utilized inkjet technology in order to obtain high quality photo prints. In conventional inkjet printers, there may be a carriage having one or more ink cartridges removably mounted therein. Each cartridge may utilize a printhead for directing ink to a media sheet passing adjacent thereto. The carriage unit is adapted to sweep the ink cartridge in a path of travel adjacent to the media, which is typically moved in a transverse or orthogonal direction to the carriage unit. As the printhead sweeps or scans adjacent the media, ink droplets are ejected onto the medium sheet which is typically supported from below by a platen.

In conventional inkjet printing, manufacturers have strived to avoid ink smearing on the underside of a media sheet. Smearing may occur when ink is misdirected onto printer components adjacent the feedpath and the media touches such component. One way of avoiding ink on printer components is to form margins. Accordingly, conventional printers inhibit ejection of ink onto the leading, trailing, and side edges of the medium sheet. This creates sheet margins, and in turn, protects the upper surface of the supporting platen from receiving ink droplets being ejected by the printhead. However, the advent of photo printing has led to a desire to print borderless images, which appear similar to professionally developed photographs.

Manufacturers have encountered difficulty in providing a detailed photo image up to the media edge, also known as edge-to-edge printing. As media leading edges and trailing edges pass through a print zone, the media tends to sag or bend, resulting in changing of the distance between the printhead and media making edge printing difficult. One manufacturer has employed the use of a trough filled with an absorbing foam for the sprayed ink. Projecting through the foam and extending from the bottom of the trough and centered between the two walls of the through is single row of a plurality of narrow column-like structures, each having a relatively broad rounded-over top. The column tops extend above the top of the foam and support the underside of the media during its travel through the print zone. One drawback with this approach is the width of the supports. The relatively large area of the support becomes an area where the sprayed ink can accumulate and possibly smudge the undersurface of the media. Also a large number of support columns are used along the length of the through increasing the chances of ink accumulation and smudging.

To ensure that there are no blank areas along the media edges and to compensate for positional errors, the printhead must also fire ink from nozzles which are slightly beyond the edge of the media. Thus, the printed area will include the edges of the media and eliminate blank areas therealong. However, since the media must be oversprayed to ensure printed ink along the edges, ink ejected from the nozzles spreads to areas where media does not exist and may adhere to the printer components generally adjacent the print zone, such as the platen or ribs. When a subsequent medium passes through this area, ink may be smudged on a surface of the media facing the platen or ribs.

Another difficulty which printer manufacturers have struggled with is maintaining a constant distance between the printhead and the media. This causes a change in distance between the printhead and the media being printed on and further results in decreased print quality especially along media edges. It is preferable that a gap between the nozzles of the printhead and the media must always be maintained constant since any change in distance may adversely affect photo print quality. However, due to the water content of ink, the media is subject to a phenomenon known as "cockle" consisting of swelling and expansion of the media during printing. When cockle occurs, the media forms bubbles and wrinkles and, as a result, the distance between the paper and printhead decreases in some areas. As a result, the distance between the printhead and media changes. The cockling of the media may also result in "vertical banding" because the bubble in the media may cause the ink dots to fall in positions offset from their correct position, e.g. all displaced toward the same side, leaving visible marks on the plot in the form of parallel lines. These issues also increase the difficulty of edge-to-edge printing.

Given the foregoing, it will be appreciated that an apparatus is needed which supports media moving through a print zone at a substantially constant distance from the printhead and also inhibits ink smearing on subsequent media.

SUMMARY OF THE INVENTION

The present invention improves edge-to-edge printing by providing improved support structures.

According to a first embodiment, a trough support rib for improved edge-to-edge printing comprises a media feedpath extending in a first direction, a printhead reciprocally movable in a second direction, the second direction defining a print zone, an ink trough, at least one support rib beneath the print zone within the ink trough, the at least one support rib having an upper angled edge for engaging print media defined by two beveled surfaces, the rib further comprising a notch for removal of overspray ink to said ink trough. The ink trough further comprises an upstream wall, a downstream wall, and at least one trough floor extending between the upstream and downstream walls. The at least one support rib extends from the upstream wall of the trough. The notch further comprises a lower angled edge extending substantially parallel to the upper angled edge. The upper angled edge and said lower angled edge are angled upwardly from upstream to downstream along said media feedpath. The upper end of the upper angled edge defines a contact point for media along the media feedpath. The trough support rib further comprises a plurality of exit ribs downstream of the ink trough. The at least one support rib is offset from the plurality of exit ribs in the second direction to inhibit transfer of ink from the at least one support rib to the exit ribs. The at least one support rib is adapted to support at least a trailing edge of a media sheet passing over the ink trough. The at least one support rib is adapted to support a leading edge of the media sheet passing over the ink trough.

According to a second embodiment, in a print device having a media feedpath defining a first direction and a printhead reciprocally movable above an ink trough extending in a second transverse direction, at least one trough support rib, comprises an upper angled edge defined by two beveled surfaces, the at least one trough rib disposed in the trough, the at least one trough rib having a notch, the notch has a lower angled edge defined two beveled surfaces, the at least one trough rib being offset from at least one exit rib downstream of the trough. The at least one trough support rib further comprises a primary media support rib disposed upstream of the ink trough. The primary media support rib has a height greater than the upper angled edge of the at least one trough rib. The at least one exit rib has a height substantially equal to the primary media support. The at least one trough rib is a plurality of ribs. The plurality of ribs extend from an upstream wall of the ink trough.

According to a third embodiment, a trough support rib assembly comprises an ink trough having an upstream wall and downstream wall, a plurality of trough support ribs extending from an upstream wall of the ink trough, an upper tapered edge extending along each of the plurality of ribs in a media feed direction, the upper tapered edge being defined by beveled surfaces. An upstream portion of the trough support rib is connected to a primary media support rib upstream of the ink trough. The plurality of trough support ribs further comprises a notch and a lower tapered edges substantially aligned with the upper tapered edge. The lower tapered edges are each defined by first and second beveled surfaces. A primary media support rib is connected to the at least one of the trough support ribs, the primary media support ribs being upstream of the ink trough. The primary media support ribs further comprising a height which is greater than the upper tapered edge. The trough support rib assembly further comprises a plurality of exit ribs downstream of the ink trough. The trough support ribs are offset from the plurality of exit ribs to inhibit transfer of ink to the plurality of exit ribs.

According to a fourth embodiment, a print feed path having an ink trough and an ink trough support rib, comprises a print zone, a first rib disposed beneath the print zone for supporting media moving therethrough, the first rib having a first upper angled edge defined by first and second tapered surfaces, a second rib disposed beneath the print zone for supporting media moving therethrough having a second upper angled edge defined by first and second tapered surfaces, the first rib offset from the second rib in a first media feed direction and a second direction transverse to the first media feed direction. The first rib is substantially U-shaped. The first upper angled edge is disposed at one end of the first rib and a third upper angled edge is disposed at a second end of the first rib. The first upper angled edge and the third upper angled edge are aligned in the first media feed direction. The first rib further comprising at least one notch adjacent one of the first upper angled edge and the third upper angled edge. The at least one notch has tapered surfaces defining a lower edge. The at least one notch comprises a notch disposed on an upstream side of the first upper angled edge and a downstream side of the third upper angled edge. The ink trough support rib further comprises a notch on said second rib. The notch on the second rib further comprising a lower angled edge. The lower angled edge is longer than an upper angled edge of the second rib.

According to a fifth embodiment, in an print device for edge to edge printing having a media feedpath extending in a first direction, an ink trough support assembly comprises an ink trough disposed adjacent an inkjet carriage, the ink trough extending in a second direction transverse to the first direction, a first rib and a second rib disposed in the ink trough, the first rib having first and second upper angled edges defining upper contact points aligned in the first direction, the second rib having an upper angled edge disposed between the first and second upper edges of the first rib in the second direction, the first rib and the second rib providing support for media leading edge and trailing edge across the ink trough in the first media feed direction. The ink trough assembly further comprising the first rib and second rib being spaced apart in the second direction. The ink trough assembly further comprising the plurality of exit ribs downstream of the ink trough and a plurality of primary media support ribs upstream of the ink trough. The upper edge of the first and second rib is angled from an upper downstream position to a lower upstream position. The first rib is a plurality of ribs and the second rib is a plurality of ribs. The first and second ribs are equidistantly spaced in the second direction. The first and second ribs extend from an upstream wall of the ink trough.

According to a sixth embodiment, an ink trough support rib assembly comprises an ink trough disposed adjacent a print zone, a first plurality of ribs disposed in the ink trough having first and second upper angled edges, a second plurality of ribs disposed in the ink trough having a first upper edge, each of the second plurality of ribs equidistantly spaced between the first plurality of ribs in the scanning direction, each of the upper edges of the second rib disposed between the first and second upper edges of the first rib.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
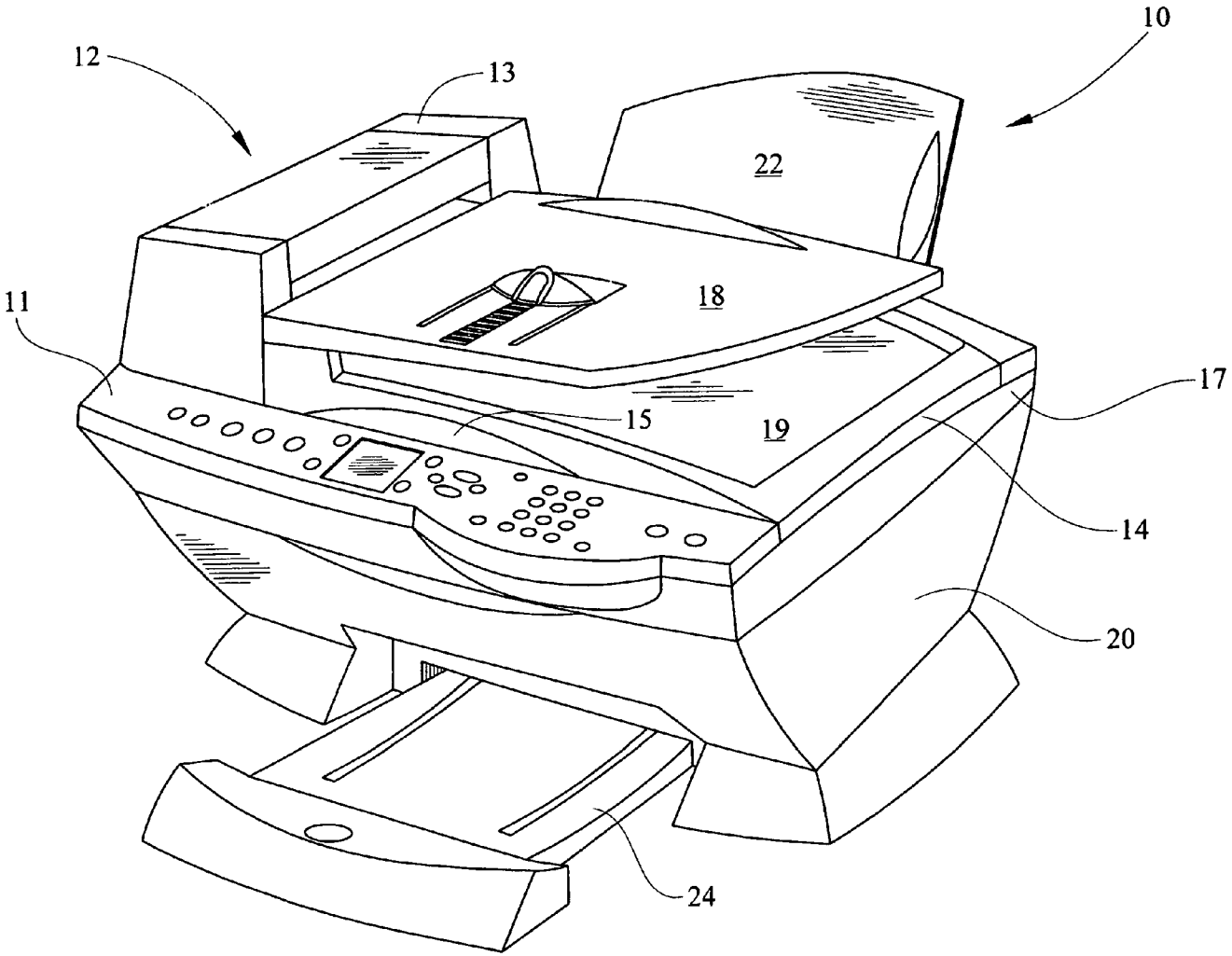
FIG. 1 is a perspective view of an all-in-one device including a printing component.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and all-in-one devices that incorporate multiple functions such as scanning, copying, and printing capabilities in one device. Such printing devices may utilize ink jet, dot matrix, dye sublimation, laser, and any other suitable print formats. The term button as used herein means any component, whether a physical component or graphic user interface icon, that is engaged to initiate output.

Referring now in detail to the drawings, wherein like numerals indicate like elements throughout the several views, there are shown in FIGS. 1-14 various aspects of trough support ribs. The apparatus provides trough ribs for supporting media spanning the ink trough, improving edge-to-edge printing as well as minimizing contact with the media. The ribs further enhance movement of ink overspray to an ink trough.

Referring initially to FIG. 1, an all-in-one device 10 is shown having an ADF scanner portion 12 and a printer portion 20, depicted generally by the housing. The all-in-one device 10 is shown and described herein, however one of ordinary skill in the art will understand upon reading of the instant specification that the present invention may be utilized with a stand alone printer, copier, or other printing device utilizing a media feed system. The peripheral device 10 further comprises a control panel 11 having a plurality of buttons for making selections. The control panel 11 may include a graphics display to provide a user with menus, choices or errors occurring with the system.

Still referring to FIG. 1, extending from the printer portion 20 is an input tray 22 at the rear of the device 10 and an exit tray 24 extending from the front of the device 10 for retaining media before and after a print process, respectively. A media feedpath 21 (FIG. 2) extends between the input tray 22 and output tray 24. The printer portion 20 may include various types of printing mechanisms including a dye-sublimation or an ink jet printing mechanism. For ease of description, the exemplary printer portion 20 is an inkjet printing device.

Figure 2:
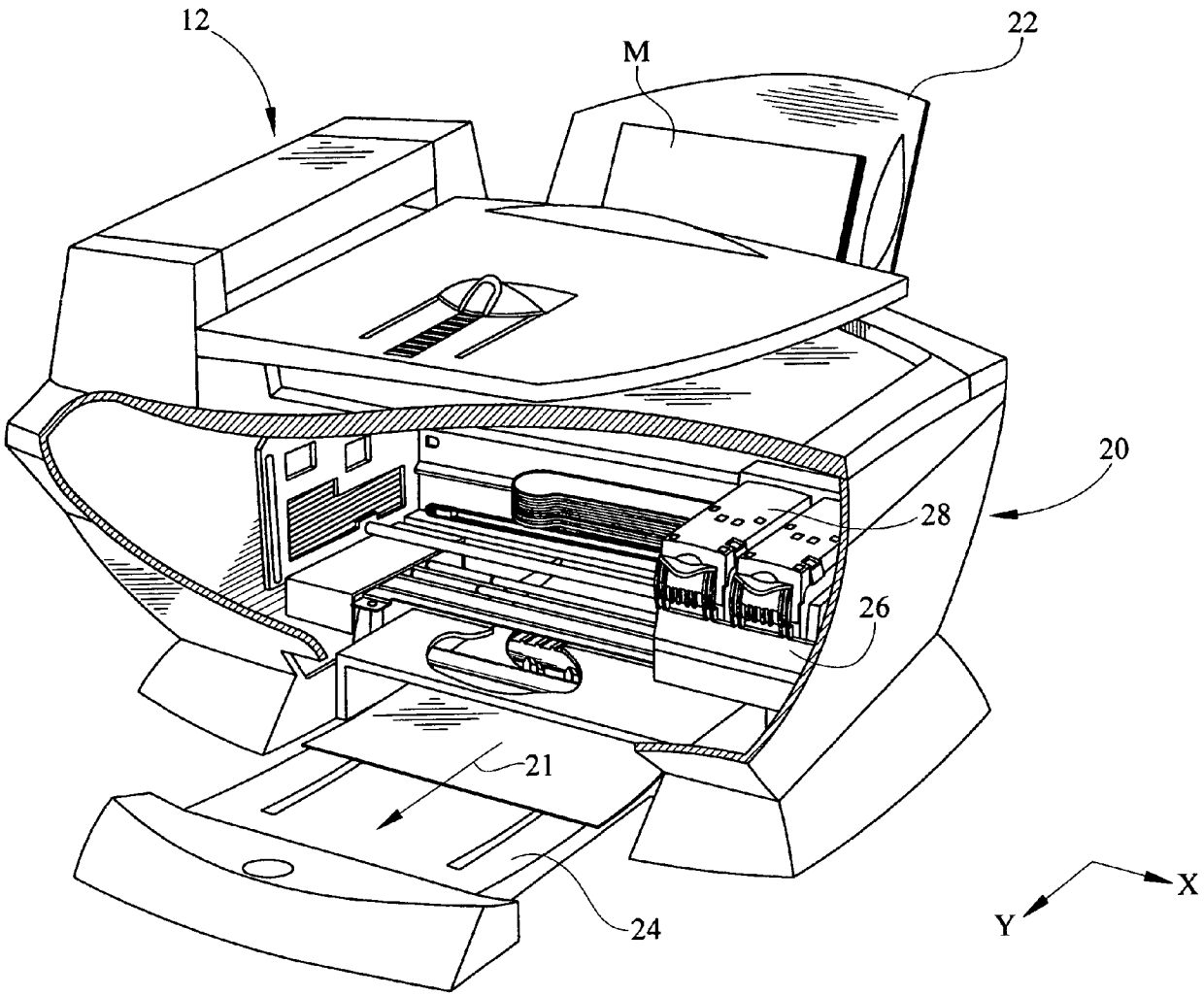
FIG. 2 is a perspective view of the all-in-one device of FIG. 1 with a cut-away section depicting the printing components.

Referring now to FIG. 2, an interior cut-away perspective view of the all-in-one device 10 is depicted. With the interior shown, the printing portion 20 includes a carriage 26 having a position for placement of at least one print cartridge 28. FIG. 2 depicts two print cartridges 28 which may be, for instance, a color cartridge for photos and a black cartridge for text printing. Also two color cartridges may also be used. As one skilled in the art will recognize, the color cartridge may include three inks, i.e., cyan, magenta and yellow inks. The second color cartridge, if used, would contain more dilute versions of these three colors. Alternatively, in lower cost machines, a single cartridge may be utilized wherein the three inks, i.e., cyan, magenta and yellow inks are simultaneously utilized to provide the black for text printing or for photo printing. During advancement media moves from the input tray 22 to the output tray 24 in a substantially L-shaped media feedpath 21 beneath the carriage 26 and cartridges 28. As the media moves into a printing zone, the media moves in a first, Y-direction as depicted and the carriage 26 and the cartridges 28 move in a second, X-direction which is transverse to the movement of the media M.

Referring again to FIG. 1, the scanner portion 12 generally includes an ADF scanner 13, a scanner bed 17 and a lid 14 which is hingedly connected to the scanner bed 17. Beneath the lid 14 and within the scanner bed 17 may be a transparent platen for placement and support of target or original documents for manually scanning. Along a front edge of the lid 14 is a handle 15 for opening of the lid 14 and placement of the target document on the transparent platen (not shown). Adjacent the lid 14 is an exemplary duplexing ADF scanner 13 which automatically feeds and scans stacks of documents which are normally sized, e.g. letter, legal, or A4, and suited for automatic feeding. Above the lid 14 and adjacent an opening in the ADF scanner 13 is an ADF input tray 18 which supports a stack of target media or documents for feeding through the auto-document feeder 13. Beneath the input tray 18, the upper surface of the lid 14 also functions as an output tray 19 for receiving documents fed through the ADF scanner 13.

Figure 3:
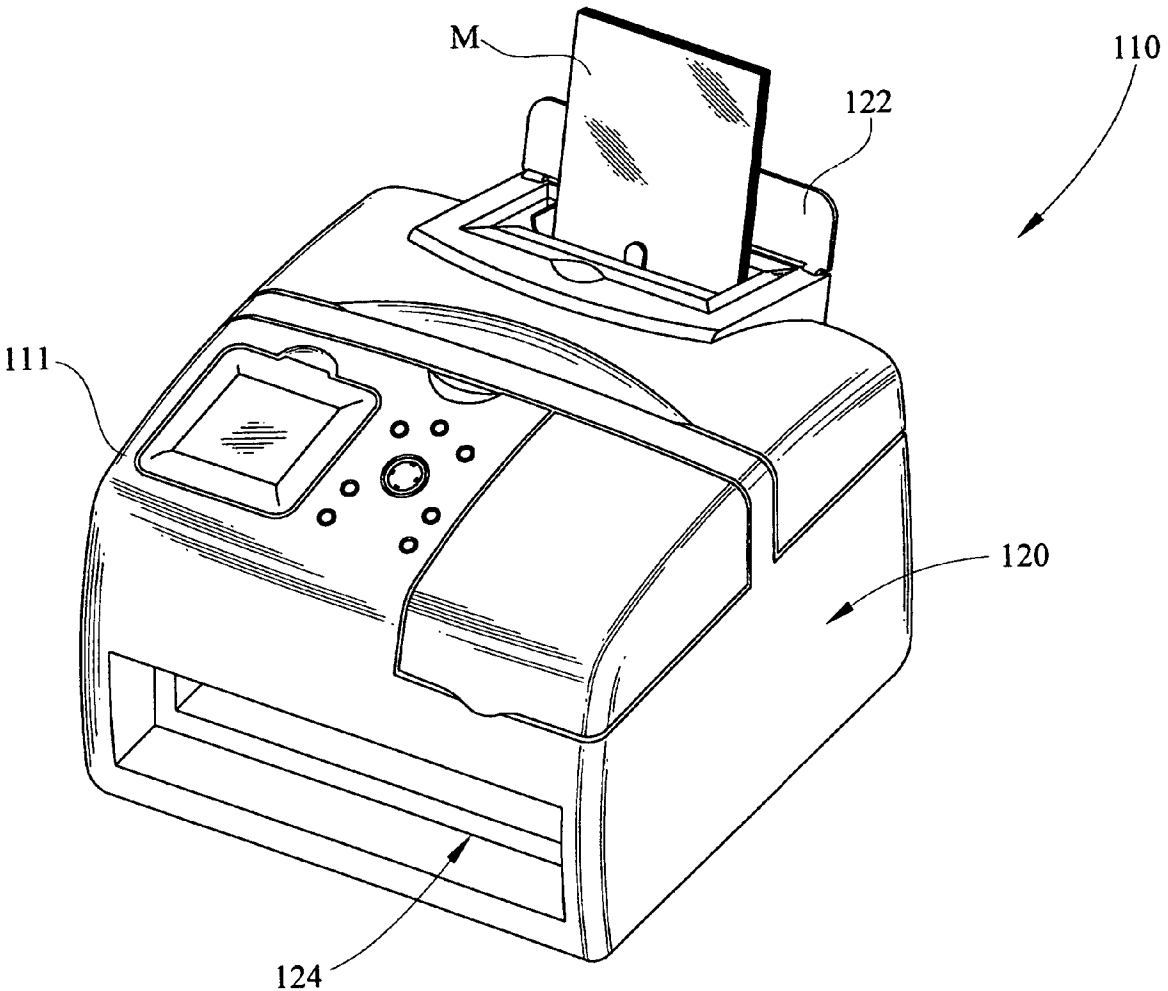
FIG. 3 is a perspective view of an alternative photo printer which performs edge-to-edge printing.

Referring now to FIG. 3, an alternative photo printer 110 is depicted which may also utilize the trough support ribs of the present invention. The photo printer 110 comprises a printer portion or component, depicted generally as 120. The upper front surface of the photo printer 110 may utilize a control panel 111 having a plurality of control buttons as well as an LCD screen for displaying photos to be printed. The control buttons may also be utilized to format the photos within the LCD display prior to printing. The photo printer 110 comprises an input tray 122 near the rear surface of the printer 110. The input tray 122 is substantially vertical and receives a plurality of media M therein. The output area 124 is substantially horizontal so that a media feedpath (not shown) extending through the printer 110 is substantially L-shaped. It should be noted however, that in either of the embodiments of FIGS. 1-3, alternative media feedpath shapes may be utilized, such as, for example, a C-shaped path.

Figure 4:
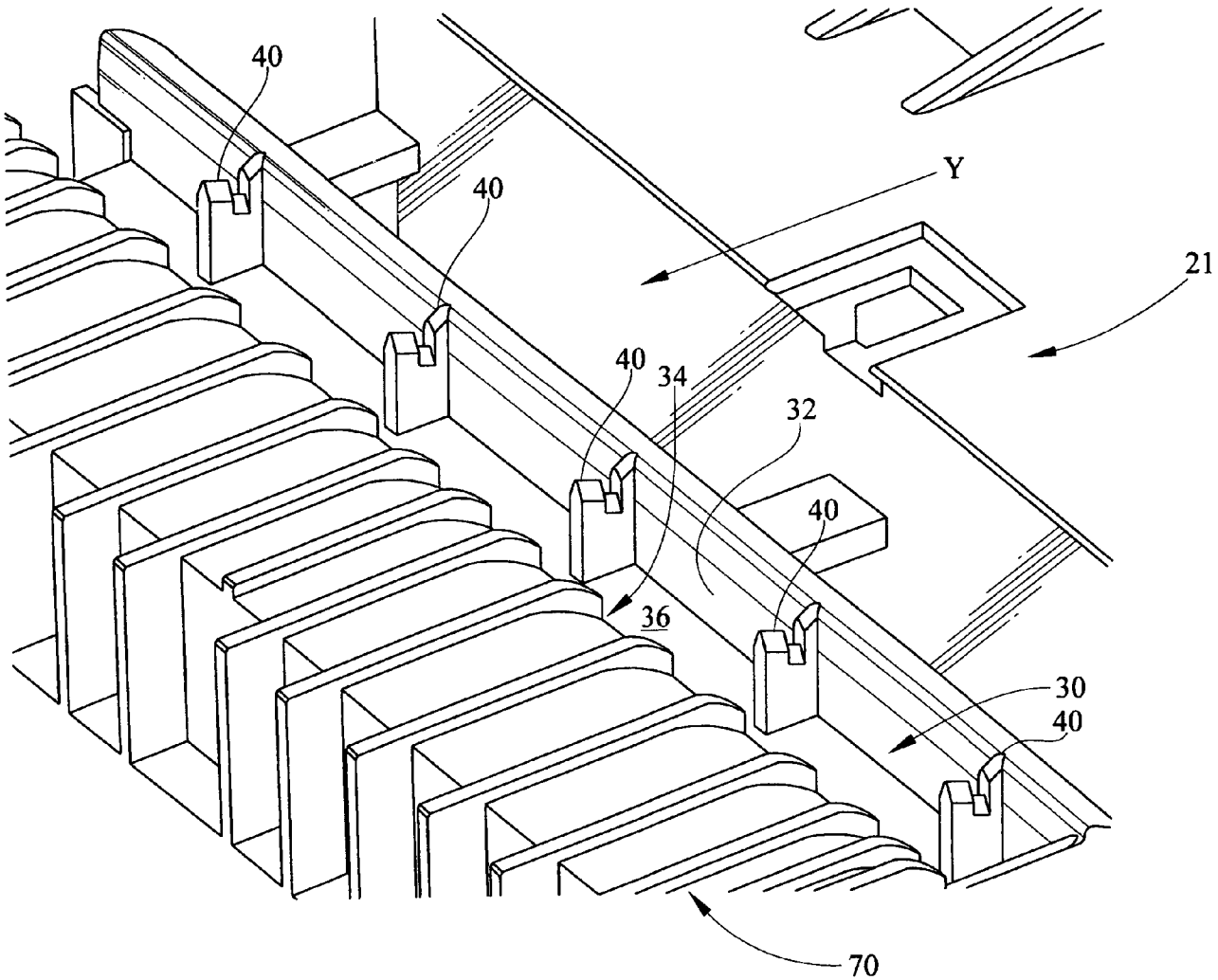
FIG. 4 is a perspective view of a first embodiment of an ink trough including support ribs of the present invention.

Referring now to FIG. 4, a perspective view of a media feedpath 21 is depicted near a print zone along the interior of the printing component 20. It should be noted that the printing component 20 and media path 21 of the all-in-one device is discussed herein but such printing device could alternatively be a photo printer or any other inkjet printer which performs edge-to-edge printing and therefore is not limited to the all-in-one device depicted in FIGS. 1 and 2. The media path 21 is depicted as having a media feed direction Y which corresponds to the media feed direction Y in FIG. 2. Disposed along the media feedpath 21, is an ink trough 30. The ink trough 30 is substantially rectangular in shape having a longer dimension in the X-direction (FIG. 2) and a shorter dimension in the Y-direction. The X-dimension is at least the length of the scanning distance of carriage 26 to catch ink over-spray. The Y-dimension is at least substantially equal to at least the length of a printhead of the cartridge 28. The ink trough 30 comprises an upstream wall 32 which extends in a substantially vertical direction. Opposite the upstream wall 32 is a downstream wall 34 which also extends substantially vertically to partially define the ink trough 30. The terms upstream and downstream are directional descriptors with respect to the Y-direction. Extending between the upstream wall 32 and downstream wall 34 is a floor 36. The floor 36 is substantially horizontal and extends between the lower edges of the upstream and downstream walls 32, 34 to define a volume which forms the ink trough 30. Downstream from the ink trough 30 are a plurality of parallel exit ribs 70. The exit ribs extend at various lengths in the Y-direction. The exit ribs 70 function to support the media which has passed through the print zone and nears the exit rollers of the print device.

Within the ink trough 30 are a plurality of ribs 40. Each of the ribs 40 extend from the upstream wall 32 downstream in the Y-direction into the ink trough 30. The ribs 40 are connected along a lower surface to the floor 36 of the ink trough 30. The ribs 40 are therefore aligned in the X-direction and support the media M as the leading edge and trailing edge pass over the ink trough 30 which is generally disposed beneath the print zone.

Figure 5:
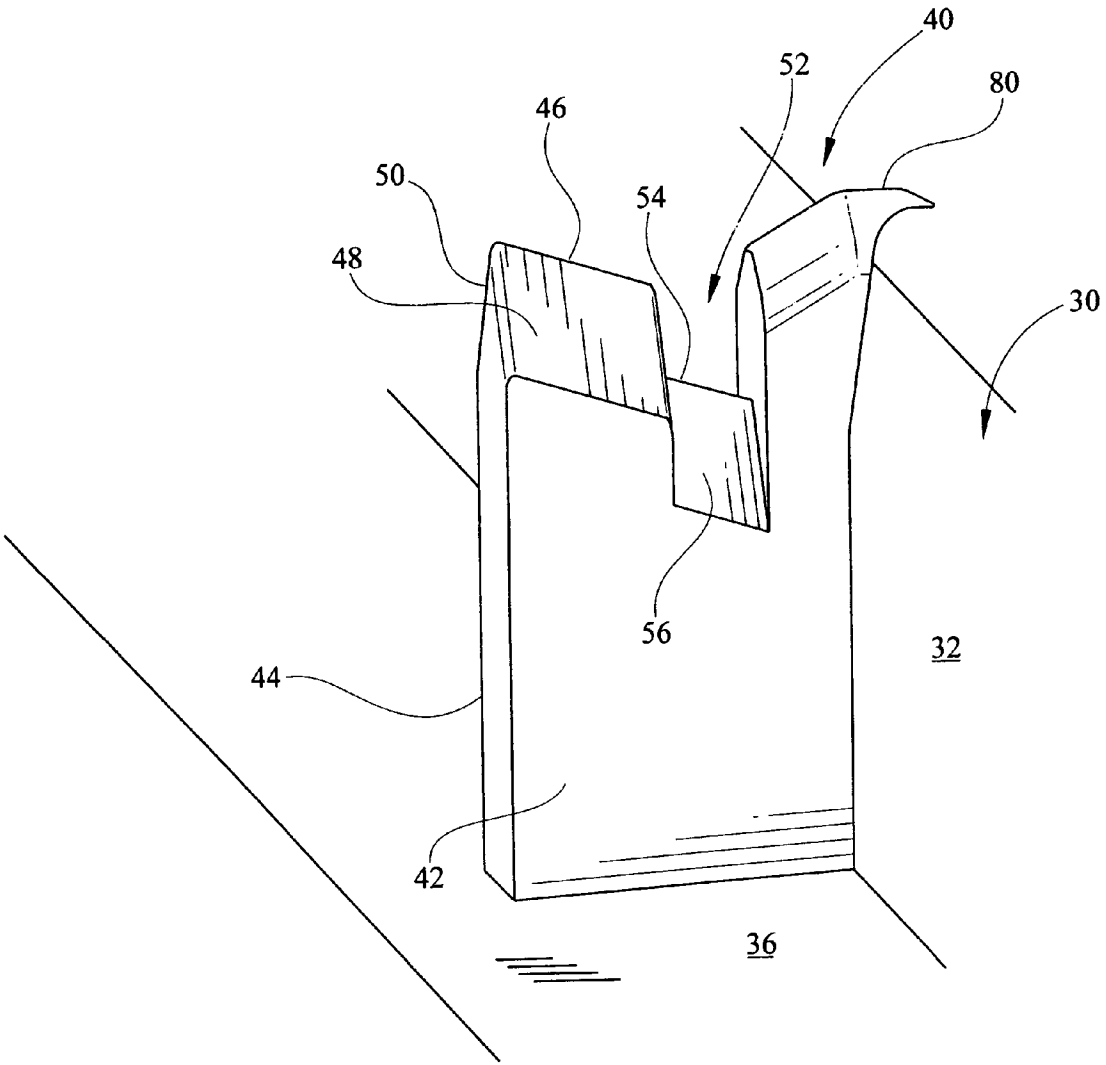
FIG. 5 is a perspective view of one the support ribs of FIG. 4.

Referring now to FIG. 5, a perspective view of one rib 40 is depicted in the ink trough 30. The rib 40 extends from the upstream wall 32 and into the trough 30 along the floor 36. The rib 40 has a first wall 42 and a second opposed wall 44. The walls 42, 44 extend upwardly from the floor 36 and along the upstream wall 32. The first and second walls 42, 44 are generally substantially U-shaped with the upstream sides having a height which is slightly greater than the downstream sides. The downstream side of the rib 40 comprises an upper tapered edge 46. The upper tapered edge 46 is defined by a first tapered surface 48 and a second tapered surface 50. The upper tapered edge 46 provides less exposed surface area than a flat surface along the upper portion of the rib 40 thereby decreasing the transfer of overspray ink from the rib 40 to the medium M passing above the rib 40. Since the edge 46 also has a taper, the uppermost downstream side of the rib 40 acts as a contact point rather than a larger contact surface area and further minimizes the transfer of ink overspray from the rib 40 to the media M passing above.

The upper tapered edge 46 is higher at a downstream position than an upstream position which minimizes a contact with the media as the media passes above the rib 40. The upstream side of the rib 40 is connected to a primary support rib 80. The media M stays in contact with the primary support rib. More specifically, the taper of the edge 46 enhances movement of the ink overspray downward along the tapered edge 46 and into the trough 30. Further, the overspray ink also moves down the first and second tapered surfaces 48, 50. Thus, ink movement is directed away from the upper tapered edge 46 which decreases the possibility of ink smear affecting a medium M passing above the rib 40.

Figure 7:
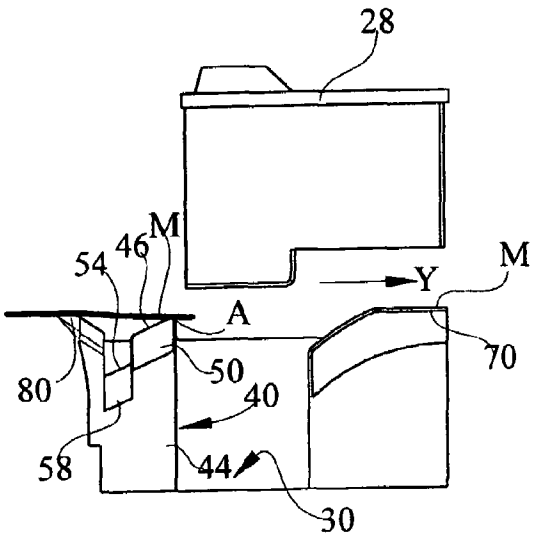
FIG. 7 is a first sequence side view of the embodiment of FIG. 4.

Moving downward from the uppermost position of the tapered edge 46, the rib 40 steps down defining a notch 52. The notch 52 comprises a lower tapered edge 54. The lower tapered edge 54 is parallel to the upper tapered edge 46 and extends in the Y direction or the media feed direction. Like the upper tapered edge 46, the lower tapered edge 54 is also higher at a downstream end than an upstream end. The edge 54 is defined by a first lower tapered surface 56 and a second lower tapered surface 58 (FIG. 7). The edge 54 provides less surface area for overspray ink to engage. The notch 52 may receive overspray of ejected ink directly or may receive ink which runs from the first and second tapered surfaces 48, 50 or from the upper tapered edge 46. The lower tapered surfaces 56, 58 direct movement of the ink from the rib 40 down the walls 42, 44 and into the ink trough 30 and therefore also inhibit ink smear.

Figure 6:
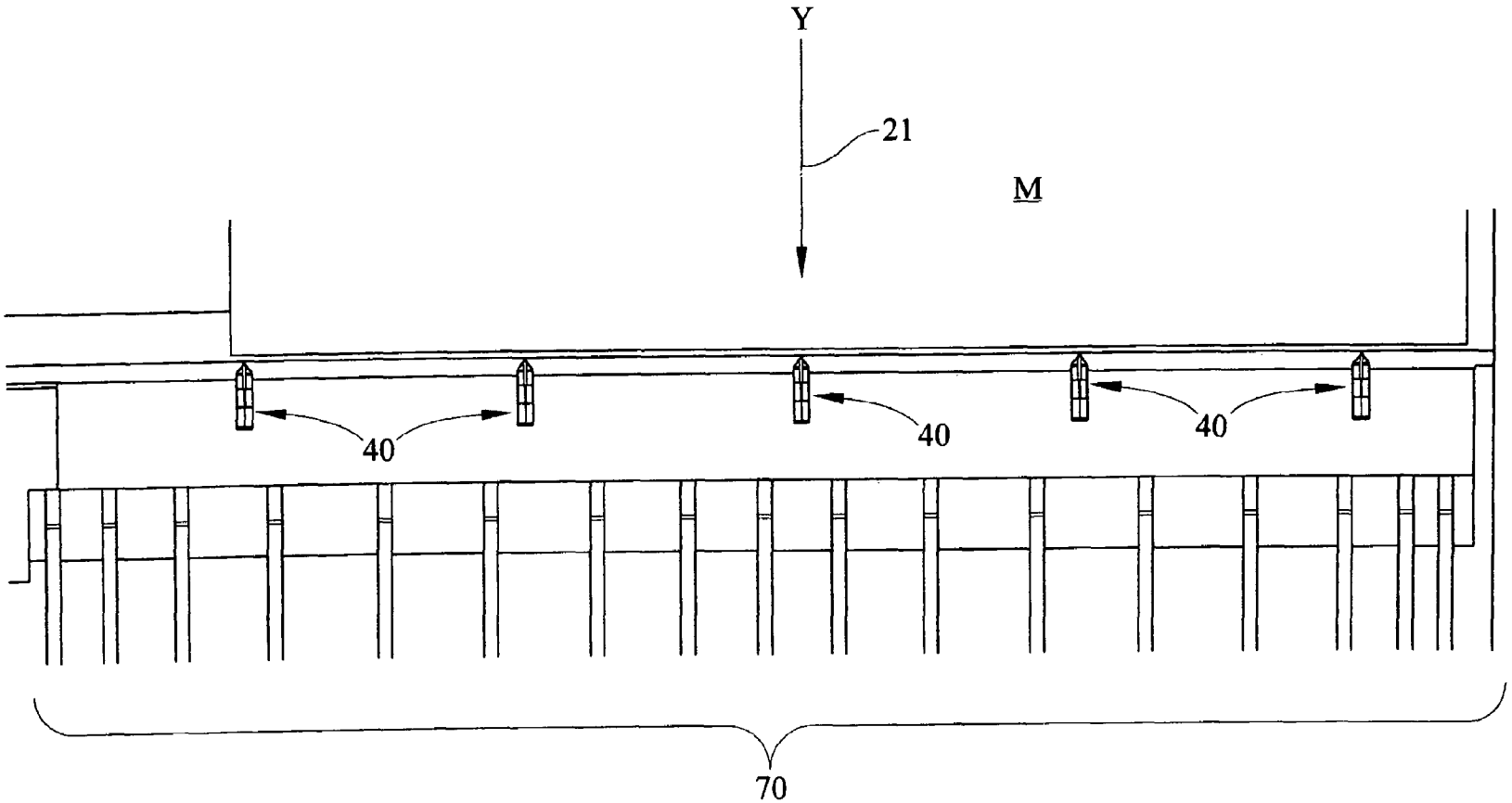
FIG. 6 is a top view of the first embodiment of the support ribs of FIG. 4.

Referring now to FIG. 6, a top view of the ink trough 30 is depicted within the media feedpath 21. Within the ink trough 30 are the plurality of support ribs 40. Downstream of the plurality of ribs 40, in the media feed direction Y, are a plurality of exit ribs 70. The top view clearly depicts that the ribs 40 are each offset from the exit ribs 70 in the X-direction. Thus, the ribs 40 are not aligned with the exit ribs 70 in the Y-direction. This offset design inhibits transmission of any ink which contaminates the support ribs 40 from being transferred to the exit ribs 70. Specifically, if ink contaminates the support ribs 40 and is transferred to a subsequent sheet of media M, the medium will pass over the exit ribs 70. However, because of the offset any ink transferred from a rib to the medium will not contaminate the exit rib 70.

Figure 9:
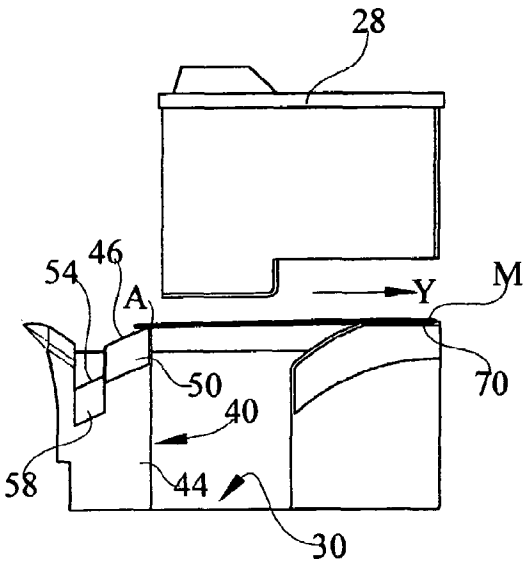
FIG. 9 is a third sequence side view of FIG. 7.
Figure 8:
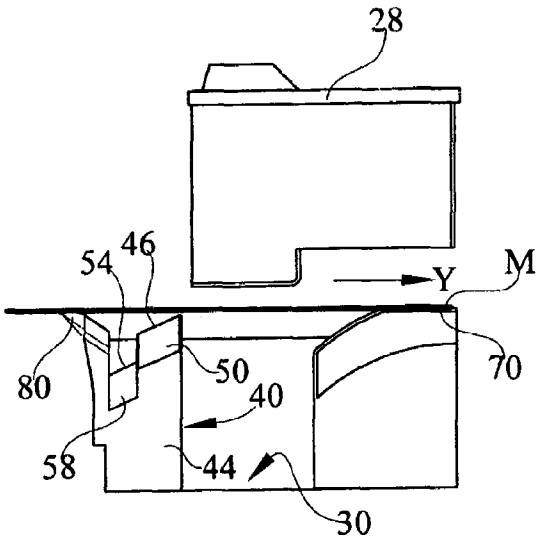
FIG. 8 is a second sequence side view of FIG. 7.

Referring now to FIGS. 7-9, a sequence of side views depicts a leading edge of the medium M traveling in the media feed direction Y through the print zone and over the ink trough 30 and depict the ink trough 30 and trough support rib 40 from the opposite side depicted in FIG. 5. FIGS. 7-9 also show the ink trough 30 adjacent the print cartridge 28. The medium M is moving in the Y direction along the media feed path 21. At point A, the leading edge of the medium M is engaging the trough support ribs 40 as the media M enters the print zone.

FIG. 8 depicts the media M continuing to move in the feedpath 21, along the feeding direction Y. The trailing portion of the media M is supported by the primary media support rib 80. The leading edge of the media M is supported by the exit ribs 70. The media M is spanning the ink trough 30 from the exit ribs 70 to the primary support ribs 80. The media M is not contacting the support rib 40 since the upper edge 46 of rib 40 does not extend to the height of primary support rib 80 and exit rib 70. As shown in FIG. 8, the medium M is supported near the trailing edge and leading edge and maintains a substantially constant distance from the print cartridge 28.

Referring now to FIG. 9, the medium M is advanced further along the feed direction Y so that at point A the trough support rib 40 is supporting the medium M closer to the trailing edge as the media is directed through the print zone beneath the print cartridge 28. The media forward of the trailing edge is supported at the exit ribs 70 since the trailing edge is supported by the support rib 40, the distance between the print cartridge 28 and the medium M changes only slightly. Since the trailing edge is supported, the media M do not drop into the ink trough 30 or away from the print cartridge 28 any distance which will adversely affect print quality. The design allows for maintaining high print quality near the edge of the medium M.

Figure 10:
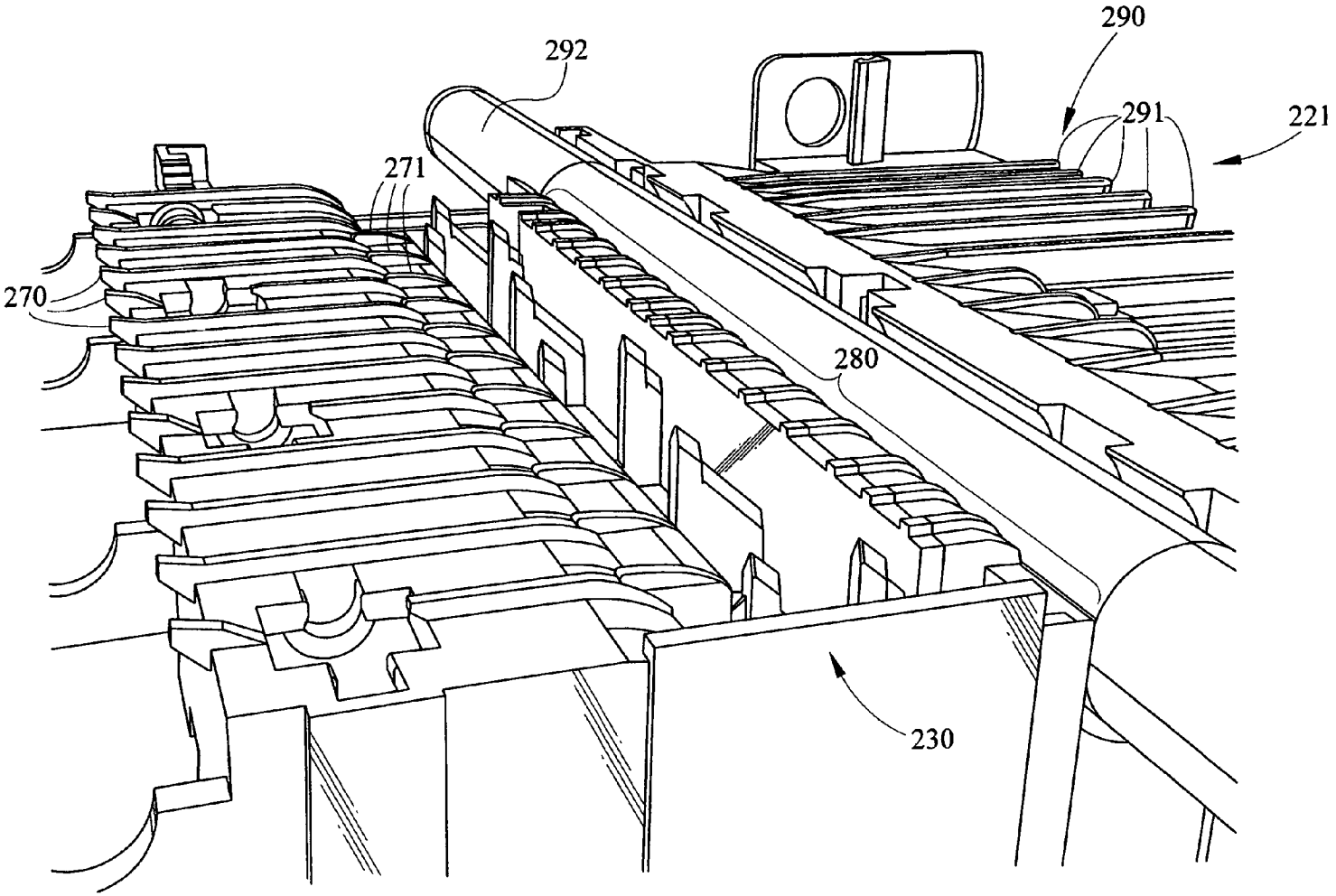
FIG. 10 is a perspective view of a second embodiment of the present invention located in the media feedpath.

Referring now to FIG. 10, a second embodiment of the trough support ribs are depicted. A mid-frame 290 is shown in perspective view comprising a plurality of components including an ink trough 230. A media feedpath 221 is depicted as extending in a direction parallel to the upper surface of the mid-frame 290. Adjacent the upstream ribs 291 is a feed roller 292 which is driven by a transmission (not shown) and a driving source (not shown) such as a motor. The feed roller 292 in combination with an opposing roller not shown forms a nip through which media is directed into the print zone immediately downstream of the feed roller 292 along the media feedpath 221 and above the ink trough 230. Immediately upstream of the ink trough 230 are a plurality of primary media support ribs or cockle ribs 280. The ribs 280 extend along the mid-frame 290 adjacent the feed roller 292 in the direction of the media feedpath 221 up to and including an upper edge portion of the ink trough 230. Downstream of the ink trough 230 are a plurality of transition ribs 271. The transition ribs 271 raise the edge of the media up to a height of the plurality of exit ribs 270 downstream of the transition ribs 271. The transition ribs 271 include an upper curved surface which is lower at an upstream end and raises toward a downstream end adjacent the upstream ends of the exit ribs 270. The transition ribs 271 aid in inhibiting media jams which would occur if the leading edge of the media passing through the media feedpath 221 and engage the exit ribs 270 without being elevated. However, one skilled in the art should recognize that the transition ribs 271 may or may not be necessary depending on the height of the ink trough 230 and primary media support ribs 280 in relation to the height of the exit ribs 270.

Figure 11:
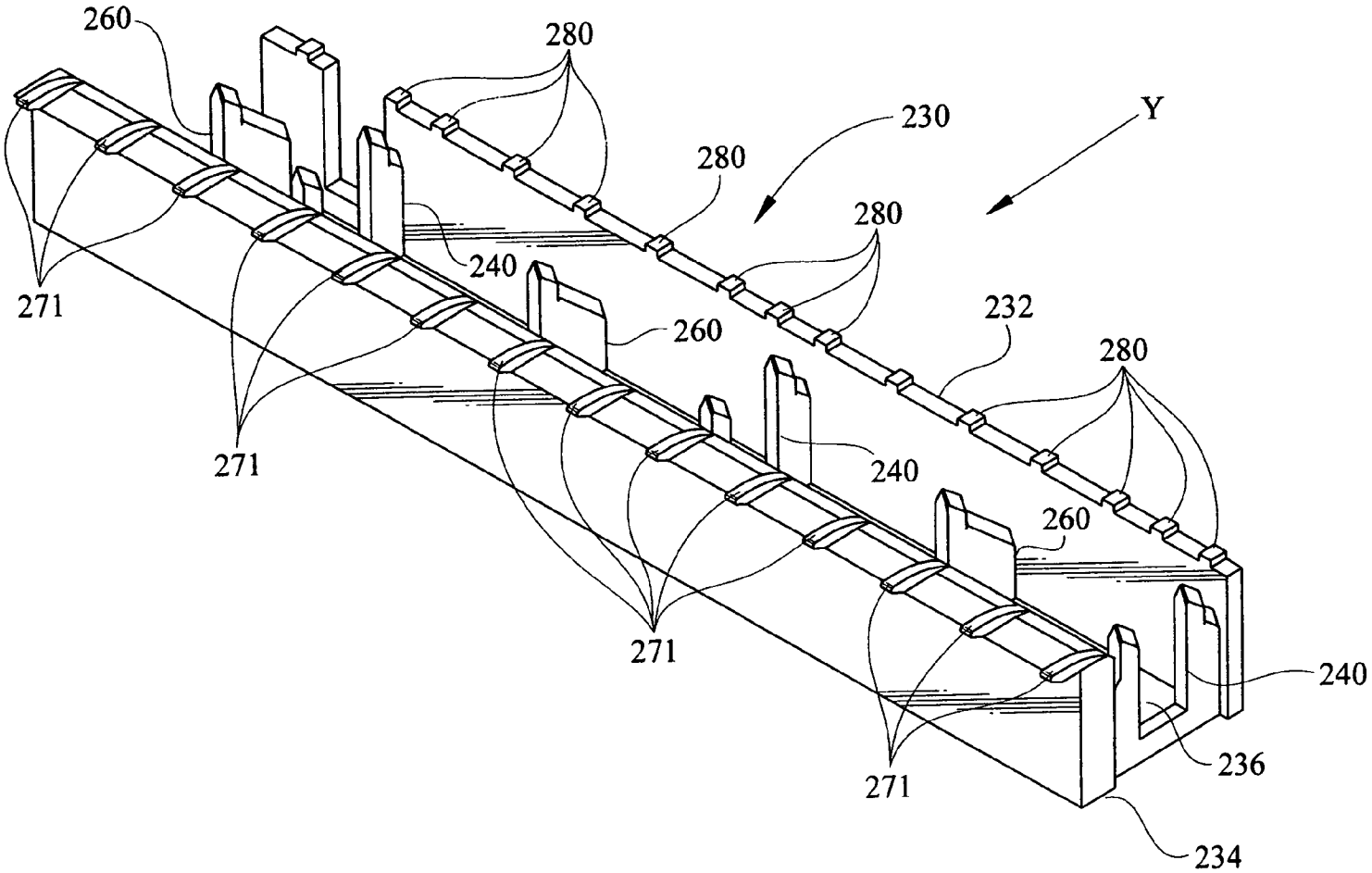
FIG. 11 is a perspective view of the second embodiment removed from the media feedpath.

Referring now to FIG. 11, a perspective view of the ink trough 230 is depicted removed from the surrounding mid-frame 290 (FIG. 10). At an upstream end of the ink trough 230 is an upstream wall 232. Along an upper edge of the upstream wall 232 are a plurality of primary media support ribs 280. The primary media support ribs 280 are an extension of the ribs along the mid-frame 290 (FIG. 10). Opposite the upstream wall 232 is a downstream wall 234. Extending between the upstream and downstream walls 232, 234 is a floor 236 which, in part, generally form a volume defining the ink trough 230. Extending along the upper surface of the downstream wall 234 of the ink trough 230 are a plurality of exit transition ribs 271. The exit transition ribs 271 have a curved upper surface which raises the leading edge of the media to a height necessary to inhibit media jams as a media leading edge engages the exit ribs 270 (FIG. 10). Extending from the floor 236 of the ink trough 230 are a plurality of first ribs 240 and second ribs 260.

Figure 12:
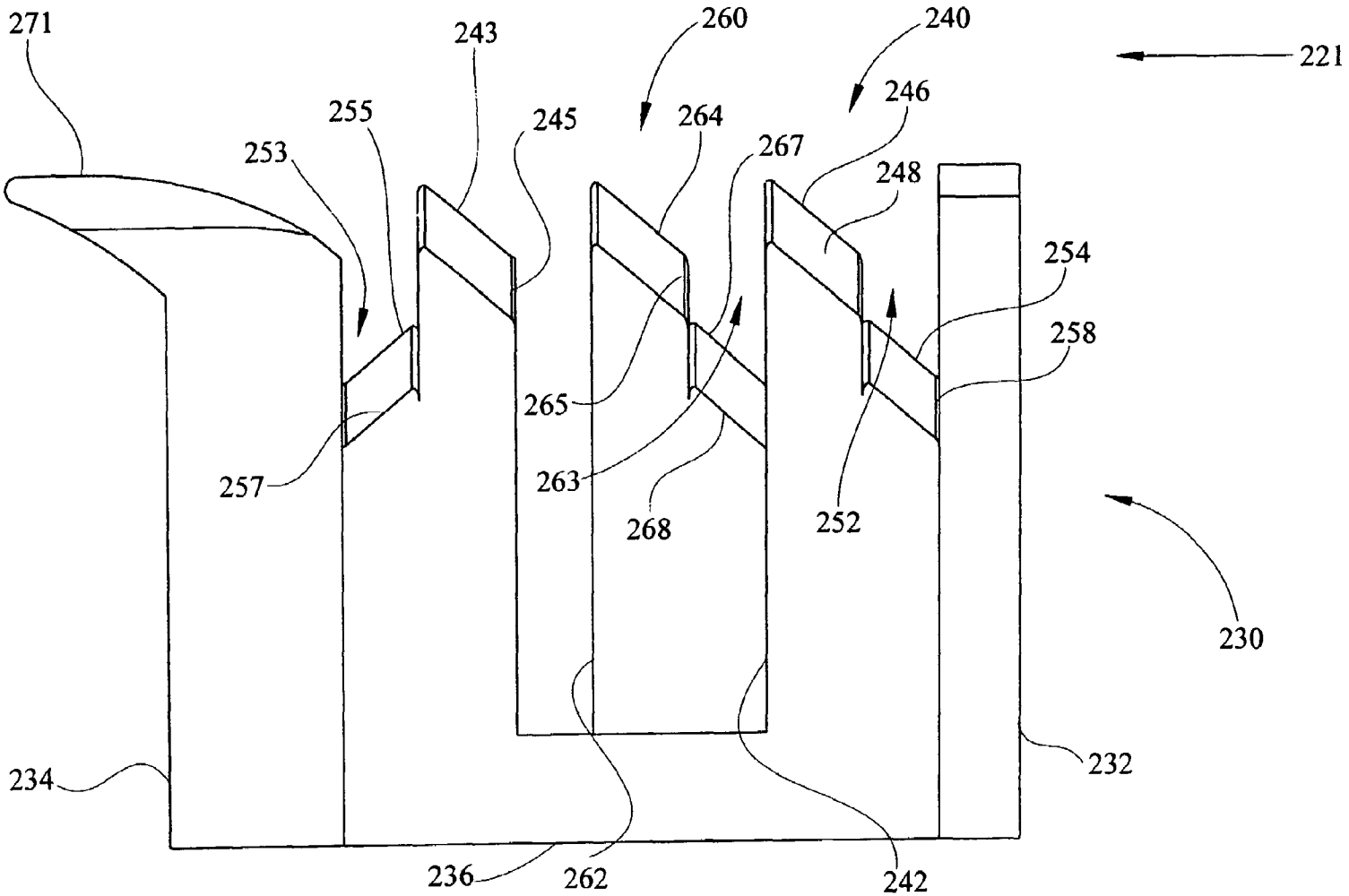
FIG. 12 is a side view of the second embodiment of the present invention from the opposite side of FIG. 11.
Figure 13:
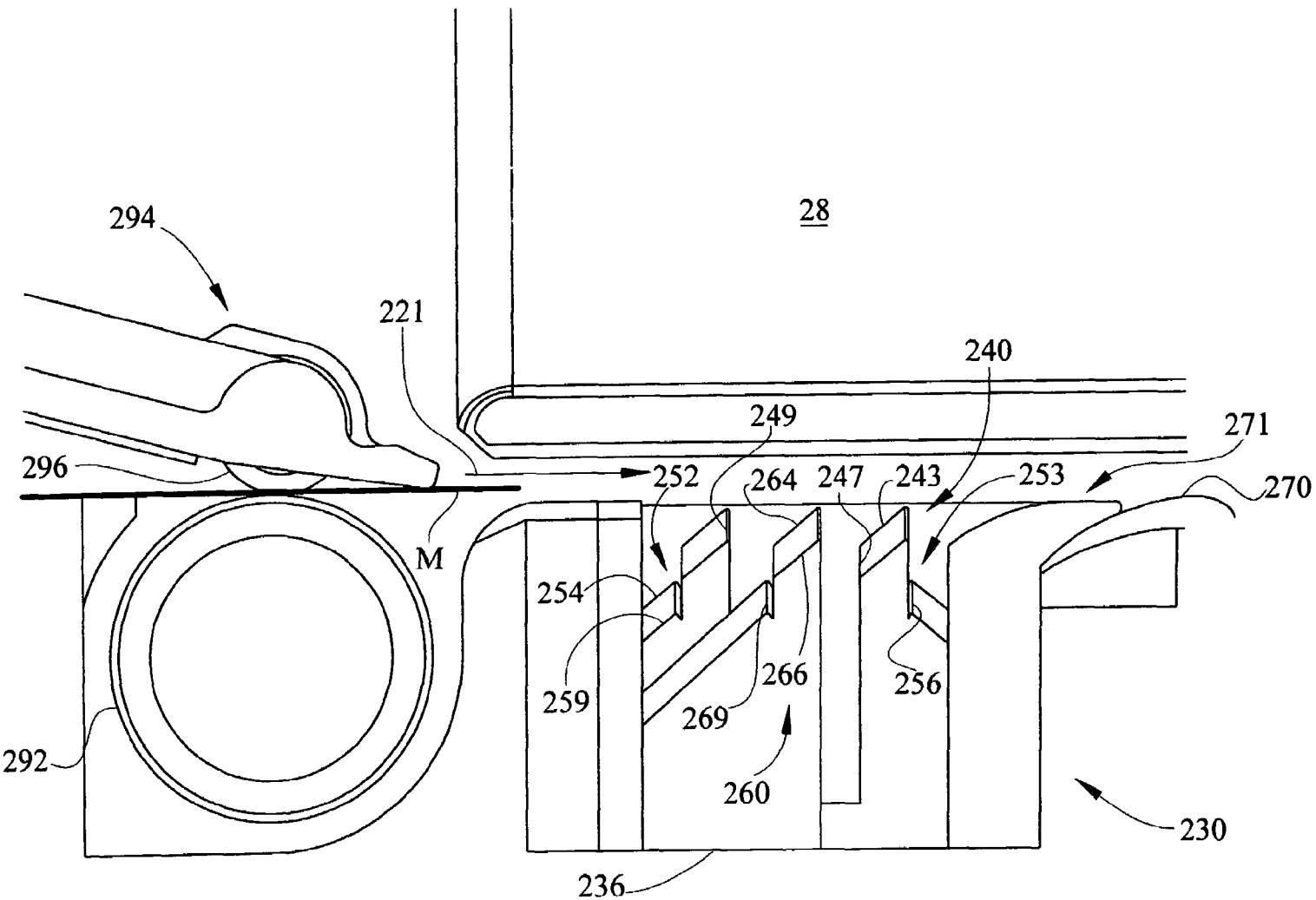
FIG. 13 is a side view of the second embodiment of the present invention; and, FIG. 14 is a top view of the second embodiment of FIG. 11.

Referring now to FIG. 12, a side view of the ink trough 230 is shown which depicts the shapes of the ribs 240, 260. The first rib 240 comprises a substantially U-shaped body 242. For rib 240, on the upstream side and downstream side of the feedpath 221 are angled upper edges 246 and 243, respectively, which are angled from a lower upstream end to an upper downstream end and thereby form a point at the downstream end of each edge 246, 243. The upstream angled upper edge 246 is defined by an upper tapered surface 248 and opposed surface 249 (FIG. 13). The downstream angled upper edge 243 is defined by upper tapered surface 245 and opposite surface 247 (FIG. 13). At the upper downstream end of the downstream angled upper edge 243 is a notch 253 comprising an angled lower edge 255 defined by a lower tapered surface 257 and opposite lower tapered surface 256. On the opposite (upstream) side of the U-shaped body 242 a notch 252, is defined between the angled upper edge 246 and the upstream wall 232 of the ink trough 230. The notch 252 comprises an angled lower edge 254 which is angled from a lower upstream end to an upper downstream end. The lower edge 254 is defined by a lower tapered surface 258 and opposite surface 259 (FIG. 13). The U-shaped body 242 extends from the upstream wall 232 to the downstream wall 234 and along the floor 236 of ink trough 230. The plurality of first ribs 240 are spaced along the length of the ink trough 230.

FIG. 12 also depicts the second rib 260. The second rib 260 is defined by a body 262 extending from the upstream wall 232 of the ink trough 230 and is disposed between each of the first ribs 240 within the ink trough 230. The body 262 extends from the upstream wall 232 and upwardly from the floor 236. The second rib 260 comprises an angled upper edge 264 which is angled from a lower upstream end to an upper downstream end of the edge. The uppermost end of the upper edge 264 has a height which is substantially equal to the highest points of the angled upper edges 243, 246 of the first rib 240. The angled upper edge 264 is defined by an upper tapered surface 265 and opposed tapered surface 266 (FIG. 13). Upstream of the angled upper edge 264 is a notch 263 extending from the upstream wall 232. The angled lower edge 267 is defined by a lower tapered surface 268 and opposite tapered surface 269 (FIG. 13). The angled lower edge 267 is longer than the angled upper edge 264 and extends to the upstream wall 232. Each of the tapered surfaces of the first and second ribs 240, 260 aid in moving oversprayed ink away from the upper edges and lower edges of the ribs 240, 260. This inhibits ink from transferring to the rear surface of the media. The height of the uppermost points of the upper edges of ribs 240, 260 are less than the primary media support ribs 290 and exit transition ribs 271. Thus, the media moving across feedpath 221 will only engage the first and second ribs 240, 260 as the leading edge and trailing edge of the media M extends over the ink trough 230.

The upper edge 246 and lower edge 254 of the first rib 240 are aligned in the media feed direction and substantially parallel to one another. The upper edge 243 and lower edge 255 are aligned but not parallel. As a result the first ribs 240 are somewhat symmetrical about a vertical axis. Likewise, the upper and lower edges 264, 267, respectively, of the second ribs 260 are aligned and substantially parallel to one another.

Referring now to FIG. 13, the ink trough 230 is depicted from the opposite side as is shown in FIG. 12. Also depicted is the print cartridge disposed above the ink trough 230 and the media M being directed along the feedpath 221 by a feed roll 292 and a pinch roller assembly 294 having a pinch roller therein 296. Downstream of the ink trough 230, the exit transition ribs 271 are depicted adjacent the exit rib 270.

Figure 14:
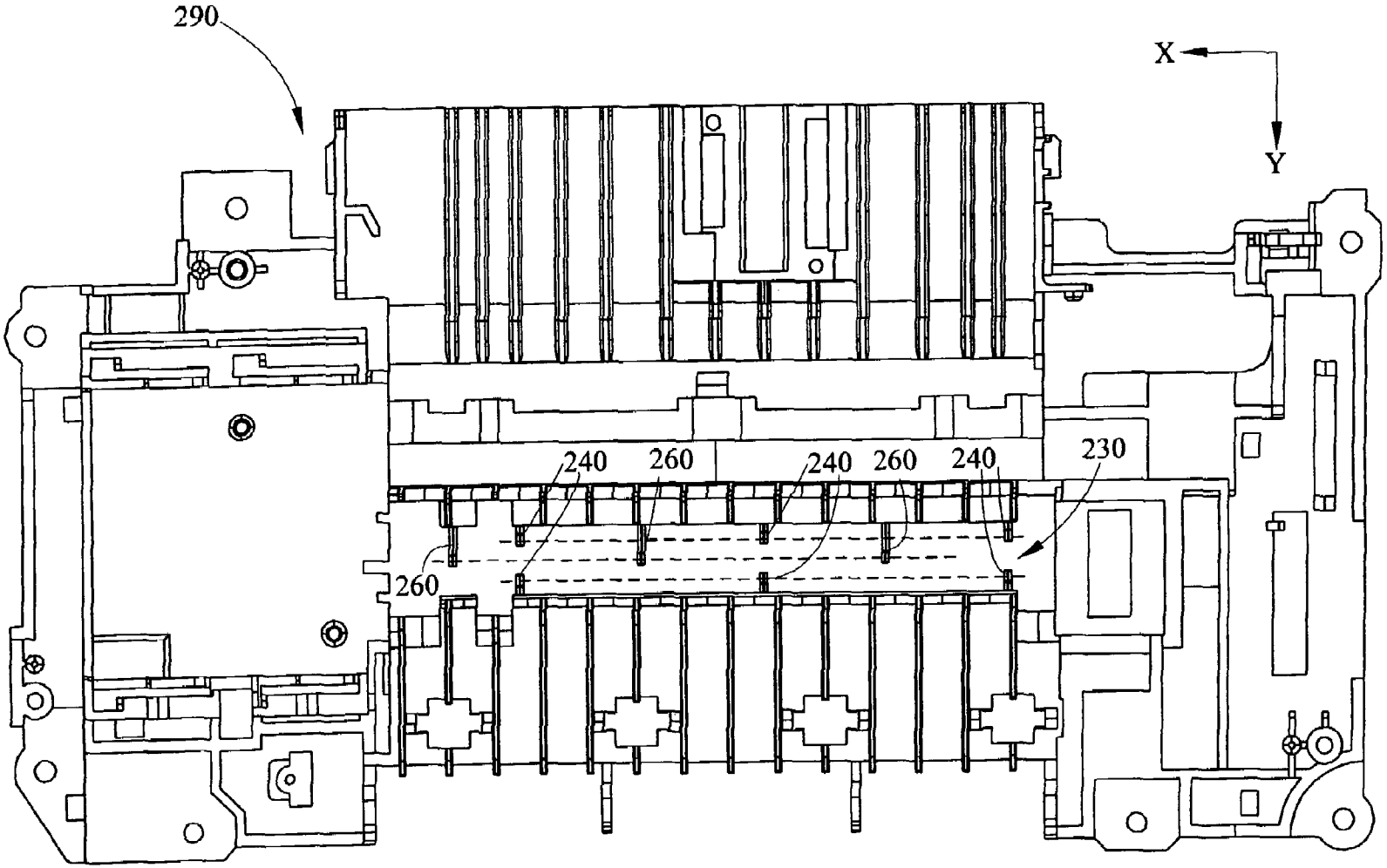

Referring now to FIG. 14, a top view of the mid-frame 290 is depicted. As shown, the ink trough 230 comprises the plurality of ribs 240, 260 alternately disposed therein in the x-direction or carriage scan direction. The ribs 240, 260 are equidistantly spaced across the trough 230. However, one or more ribs 240, 260 may not be spaced apart equally due to limitations of feedpath width and necessary spacing dimensions not being equally divisible. Such spacing supports the leading edge and trailing edge of the media substantially equally across the print zone and the ink trough 230 below. As shown in FIGS. 12 and 14, the second ribs 260 are offset in the media feed direction or y-direction with respect to ribs 240. Due to such offset, the upper edge 264 of second rib 260 is disposed between the upper edges 243, 246 of first rib 240.

As previously indicated, the media leaving and trailing edges need support as they move across the ink trough 230. The spacing of the ribs 240, 260 in the x-direction and offset in the y-direction provides improved support across the ink trough 230. The contact point of the upper edge 264 is positioned between the contact points of the upper edges 243, 246. As shown by the three dashed lines, three lines of point support are provided to the leading and trailing edges of the media as they traverse the trough 230. Such design improves support of media leading and trailing edges for improved edge to edge printing.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A printing device, comprising:

a media feedpath extending in a first direction;

a plurality of printheads disposed along a second direction, said second direction defining a print zone;

an ink trough;

at least one support rib beneath said print zone within said ink trough for supporting print media;

said at least one support rib having an upper angled edge for engaging the print media, said upper angled edge defined by a line formed by two intersecting beveled surfaces, said line extending downwardly in a plane parallel to the first direction and perpendicular to the second direction, said print media contacting only said upper angled edge of said at least one support rib without contacting any other portion of said at least one support rib; and said rib further comprising a notch for removal of overspray ink to said ink trough.

2. The printing device of claim 1 wherein said ink trough comprises an upstream wall, a downstream wall, and at least one trough floor extending between said upstream and downstream walls.

3. The printing device of claim 2 wherein said at least one support rib extends from said upstream wall of said trough.

4. A printing device, comprising:

a media feedpath extending in a first direction;

a plurality of printheads disposed along a second direction, said second direction defining a print zone;

an ink trough;

at least one support rib beneath said print zone within said ink trough;

said at least one support rib having an upper angled edge for engaging print media, said upper angled edge defined by a line formed by two intersecting beveled surfaces, said line extending downwardly in a plane parallel to said first direction and perpendicular to said second direction; and said rib further comprising a notch for removal of overspray ink to said ink, wherein said notch further comprises a lower angled edge extending substantially parallel to said upper angled edge.

5. The printing device of claim 4 wherein said upper angled edge and said lower angled edge are angled upwardly from upstream to downstream along said media feedpath.

6. The printing device of claim 4 wherein an upper end of said upper angled edge defines a contact point for media along said media feedpath.

7. The printing device of claim 1 further comprising a plurality of primary ribs upstream of said ink trough and a plurality of exit ribs downstream of said ink trough wherein said upper edge of said support rib is lower than the upper surfaces of said primary ribs and said exit ribs.

8. The printing device claim 7 wherein said at least one support rib is offset from said plurality of exit ribs in said second direction to inhibit transfer of ink from said at least one support rib to said exit ribs.

9. The printing device claim 1 wherein said at least one support rib is adapted to support at least a trailing edge of a media sheet passing over said ink trough.

10. The printing device of claim 9 wherein said at least one support rib is adapted to support a leading edge of said media sheet passing over said ink trough.

11. A print device having a media feedpath defining a first direction and a printhead reciprocally movable above an ink trough along a second transverse direction, at least one trough support rib comprising:

an upper angled edge defined by a line formed by two intersecting beveled surfaces, said line extending downwardly in a plane parallel to said first direction and perpendicular to said second transverse direction;

said at least one trough rib disposed in said trough;

said at least one trough rib having a notch;

said notch having a lower angled edge defined by two beveled surfaces; and said at least one trough rib being offset from at least one exit rib downstream of said trough, and further connected to a primary media support rib disposed upstream of said ink trough.

12. The at least one trough support rib of claim 11 wherein said primary media support rib has a height greater than said upper angled edge of said at least one trough rib.

13. The at least one trough support rib of claim 11 wherein said at least one exit rib has a height substantially equal to said primary media support rib.

14. The at least one trough support rib of claim 11 wherein said at least one trough rib is a plurality of ribs.

15. The at least one trough support rib of claim 14 wherein said plurality of ribs extend from an upstream wall of said ink trough.

16. A trough support rib assembly, comprising:

an ink trough extending in a first direction having an upstream wall and downstream wall;

a plurality of trough support ribs disposed in said ink trough and extending inwardly from an upstream wall of said ink trough;

an upper angled edge of the trough support ribs extending along each of said plurality of ribs in a second direction transverse to the first direction; and said upper angled edge being defined by a line formed by two intersecting beveled surfaces, said line extending downwardly in a plane perpendicular to said first direction and parallel to said second direction.

17. A trough support rib assembly, comprising:

an ink trough extending in a first direction having an upstream wall and downstream wall;

a plurality of trough support ribs extending from an upstream wall of said ink trough;

an upper angled edge extending along each of said plurality of ribs in a second direction transverse to the first direction; and said upper angled edge being defined by a line formed by two intersecting beveled surfaces, said line extending downwardly in a plane perpendicular to said first direction and parallel to said second direction;

wherein an upstream portion of said trough support rib is connected to a primary media support rib upstream of said ink trough.

18. The trough support rib assembly of claim 16, wherein said plurality of trough support ribs further comprise a notch and a lower tapered edge substantially aligned with said upper tapered edge.

19. The trough support rib assembly of claim 18 wherein lower edges are each defined by first and second beveled surfaces.

20. A trough support rib assembly, comprising:

an ink trough extending in a first direction having an upstream wall and downstream wall;

a plurality of trough support ribs extending from an upstream wall of said ink trough:

an upper angled edge extending along each of said plurality of ribs in a second media feed-direction; and said upper angled edge being defined by a line formed by two intersecting beveled surfaces, said line extending downwardly in a plane perpendicular to said first direction and parallel to said second direction; and a primary media support rib connected to at least one of said trough support ribs, said primary media support ribs being upstream of said ink trough.

21. The trough support rib assembly of claim 20 said primary media support ribs further comprising a height which is greater than said upper tapered edge.

22. The trough support rib assembly of claim 16 further comprising a plurality of exit ribs downstream of said ink trough.

23. The trough support rib assembly of claim 22 wherein said trough support ribs are offset from said plurality of exit ribs to inhibit transfer of ink to said plurality of exit ribs.

24. A print feed path having an ink trough and an ink trough support rib, comprising:

a print zone;

a first rib disposed beneath said print zone for supporting moving media therethrough;

said first rib having a first upper angled edge defined by a line formed by first and second beveled surfaces intersecting each other, said moving media contacting only said first upper angled edge of said first rib without contacting any other portion of said first rib;

a second rib disposed beneath said print zone for supporting media moving therethrough having a second upper angled edge defined by first and second beveled surfaces; and said first rib offset from said second rib in the first media feed direction and the second direction transverse to said first media feed direction;

wherein said line extending downwardly in a plane parallel to a first media feed direction and perpendicular to a second direction transverse to said first media feed direction.

25. The ink trough support rib of claim 24 wherein said first rib and said second rib are substantially U-shaped.

26. The ink trough support rib of claim 25 wherein said first upper angled edge is disposed at a first end of said first rib and a third upper angled edge is disposed at a second end of said first rib.

27. The ink trough support rib of claim 26 wherein said first upper angled edge and said third upper angled edge are aligned in said first media feed direction.

28. The ink trough support rib of claim 24, said first rib further comprising at least one notch adjacent one of said first upper angled edge and said third upper angled edge, the at least one notch having an angled edge.

29. A print feed path having an ink trough and an ink trough support rib, comprising:

a print zone;

a first rib disposed beneath said print zone for supporting moving media therethrough;

said first rib having a first upper angled edge defined by a line formed by first and second beveled surfaces intersecting each other;

a second rib disposed beneath said print zone for supporting media moving therethrough having a second upper angled edge defined by first and second beveled surfaces; and said first rib offset from said second rib in the first media feed direction and the second direction transverse to said first media feed direction, said first rib further comprising at least one notch adjacent one of said first upper angled edge and said second upper angled edge, wherein said at least one notch has beveled surfaces defining a lower edge;

wherein said line extending downwardly in a plane parallel to a first media feed direction and perpendicular to a second direction transverse to said first media feed direction.

30. The ink trough support rib of claim 28, further comprising a trough in which the first and second ribs are disposed, the trough defined by an upstream wall and a downstream wall, wherein said at least one notch comprises a notch disposed on an upstream side of said first upper angled edge extending from the upstream wall and on a downstream side of said third upper angled edge extending from the downstream wall.

31. A print feed path having an ink trough and an ink trough support rib, comprising:

a print zone;

a first rib disposed beneath said print zone for supporting moving media therethrough;

said first rib having a first upper angled edge defined by a line formed by an intersection of first and second beveled surfaces;

a second rib disposed beneath said print zone for supporting media moving therethrough having a second upper angled edge defined by first and second beveled surfaces;

said first rib offset from said second rib in a first media feed direction and a second direction transverse to said first media feed direction, said first rib further comprising at least one notch adjacent one of said first upper angled edge and said second upper angled edge; and a notch on said second rib;

wherein said line defining said first upper angled edge extending downwardly in a plane parallel to a first media feed direction and perpendicular to a second direction transverse to said first media feed direction.

32. The ink trough support rib of claim 31, said notch on said second rib further comprising a lower angled edge.

33. The ink trough support rib of claim 31 wherein said lower angled edge is longer than an upper angled edge of said second rib.

34. In a print device for edge to edge printing having a media feedpath extending in a first direction, an ink trough support assembly, comprising:

an ink trough extending in a second direction transverse to said first direction;

a first rib and a second rib disposed in said ink trough;

said first rib having first and second upper angled edges each defined by a line formed by intersecting beveled surfaces, said each line extending downwardly in a plane parallel to said first direction and perpendicular to said second direction transverse to said first direction; said upper angled edges defining upper contact points aligned in said first direction;

said second rib having an upper angled edge disposed between said first and second upper edges of said first rib in said second direction; and said first rib and said second rib providing support for media leading edge and trailing edge across said ink trough in said first media feed direction, said media contacting only said upper angled edged of said first and second ribs without contacting any other portions thereof.

35. The ink trough assembly of claim 34 further comprising said first rib and second rib being spaced apart in said second direction.

36. In a print device for edge to edge printing having a media feedpath extending in a first direction, an ink trough support assembly, comprising:

an ink trough extending in a second direction transverse to said first direction;

a first rib and a second rib disposed in said ink trough;

said first rib having first and second upper angled edges each defined by a line formed by intersecting beveled surfaces, said each line extending downwardly in a plane parallel to said first direction and perpendicular to said second direction transverse to said first direction; said upper angled edges defining upper contact points aligned in said first direction;

said second rib having an upper angled edge disposed between said first and second upper edges of said first rib in said second direction;

said first rib and said second rib providing support for media leading edge and trailing edge across said ink trough in said first media feed direction; and a plurality of exit ribs downstream of said ink trough and a plurality of primary media support ribs upstream of said ink trough.

37. The ink trough assembly of claim 34 wherein said upper edge of said first and second rib is angled from an upper downstream position to a lower upstream position.

38. The ink trough assembly of claim 34 wherein said first rib is a plurality of ribs and said second rib is a plurality of ribs.

39. The ink trough assembly of claim 34 wherein said first and second ribs are equidistantly spaced in said second direction.

40. The ink trough assembly of claim 34 wherein said first and second ribs extend from an upstream wall of said ink trough.

41. An imaging device having a media feedpath and an ink trough support rib assembly for supporting media sheets in the media feedpath, comprising:

an ink trough disposed adjacent a print zone;

a first plurality of ribs disposed in said ink trough having first and second upper angled edges each defined by a line formed by intersecting beveled surfaces, said each line extending downwardly in a plane parallel to a first media feed direction and perpendicular to a second direction transverse to said first direction, the media sheets contacting only the first and second upper angled edges of the first plurality of ribs without contacting any other portions of the first plurality of ribs;

a second plurality of ribs disposed in said ink trough having first upper edges, the sheets of media contacting only the first upper edges without contacting any other portions of the second plurality of ribs; and each of said upper edges of said second rib disposed between said first and second upper edges of said first rib.

42. The imaging device of claim 41, wherein the first upper angled edges of the first ribs and the first upper edges of the second ribs being substantially parallel to each other.

43. The imaging device of claim 41, wherein each of at least one of the first plurality and second plurality of ribs includes a notch having a lower angled edge.

44. The imaging device of claim 43, wherein the lower angle edges are substantially parallel to the first upper edges.

45. The imaging device of claim 41, wherein the first plurality of ribs extend inwardly from both downstream and upstream sides of the ink trough.

46. The imaging device of claim 41, wherein each of the first ribs and the second ribs includes a notch having an angled edge.

47. The printing device of claim 1, wherein the two beveled surfaces are each substantially planar and intersect along the upper angled edge of the at least one support rib.

48. The at least one trough support rib of claim 11, wherein the upper angled edge is the only portion of the at least one trough support rib which contacts print media when in the media feedpath.

49. The at least one trough support rib of claim 11, wherein the at least one trough support rib comprises at pair of trough support ribs, a first of the trough support ribs having two upper angled edges and a second trough support rib having only one upper angled edge, media in the media feedpath contacting only the upper angled edges of the pair of trough support ribs without contacting any other portions thereof.

50. The trough support rib of claim 49, wherein a first upper angled edge of the first trough support rib being disposed downstream of said upper angled edge of the second trough support rib and a second upper angled edge of the first trough support rib being disposed upstream of said upper angled edge of the second trough support rib.

51. The trough support rib assembly of claim 16, wherein the trough support ribs extend inwardly from a downstream wall of the ink trough.

52. The trough support rib assembly of claim 16, wherein beveled surfaces intersect each other along the upper tapered edge of the trough support ribs.

53. The print feed path of claim 24, wherein the ink trough is defined by an upstream wall and a downstream wall, and the first rib extends from the upstream wall towards the downstream wall.

* * * * *